United States Patent [19]

Watanabe et al.

[11] Patent Number: 5,064,573

[45] Date of Patent: Nov. 12, 1991

[54] RESISTIVE PASTE COMPRISING OXIDES OF RUTHENIUM, LEAD, IRON AND ZINC

[75] Inventors: Shizuharu Watanabe; Hiroji Tani, both of Kyoto, Japan

[73] Assignee: Murata Mfg. Co., Japan

[21] Appl. No.: 487,624

[22] Filed: Mar. 2, 1990

[30] Foreign Application Priority Data

Mar. 2, 1989 [JP] Japan ..... 1-50614

[51] Int. Cl.[5] ..... H01B 1/06; H01B 1/08

[52] U.S. Cl. ..... 252/518; 252/519

[58] Field of Search ..... 252/518, 519; 338/162, 338/174; 501/53

[56] References Cited

U.S. PATENT DOCUMENTS 4,051,074 9/1977 Asada ..... 252/512

4,312,770 1/1982 Yu et al. ..... 252/519

4,693,843 9/1987 Kasanami et al. ..... 252/518

*Primary Examiner*—Josephine Barr

*Assistant Examiner*—Bradley A. Swope

*Attorney, Agent, or Firm*—Ostrolenk, Faber, Gerb & Soffen

[57] ABSTRACT

Disclosed herein is resistive paste containing conductive powder, which is composed of iron oxide, ruthenium oxide, lead oxide and zinc oxide, glass frit, and organic varnish. The conductive powder contains 10 to 25 atomic percent of iron oxide in terms of Fe atoms, 25 to 34 atomic percent of ruthenium oxide in terms of Ru atoms, 25 to 34 atomic percent of lead oxide in terms of Pb atoms, and 10 to 25 atomic percent of zinc oxide in terms of Zn atoms. According to this resistive paste, it is possible to obtain a resistor with small sliding noise at a low cost.

8 Claims, No Drawings

RESISTIVE PASTE COMPRISING OXIDES OF RUTHENIUM, LEAD, IRON AND ZINC

BACKGROUND OF THE INVENTION

1. Field of the Invention

The present invention relates to resistive paste which contains a conductive component prepared from iron oxide, ruthenium oxide, lead oxide and zinc oxide.

2. Description of the Prior Art

Examples of conventional resistive paste materials containing conductive components of metal oxides are $Bi_2O_3$-$RuO_2$paste which is disclosed in Japanese Patent Publication No. 27871/1976, $Pb_3O_4$-$RuO_2$ paste which is disclosed in Japanese Patent Publication No. 28162/1980, and $Fe_3O_4$-$RuO_2$-$Pb_3O_4$ paste which is disclosed in Japanese Patent Laying-Open No. 208201/1986.

Such well-known paste is applied by screen printing onto an insulating substrate of alumina, for example, and fired in the air, to provide a resistor for a semi-fixed resistor.

However, such a resistor is so inferior in slidability that sliding noise, i.e., contact resistance variation (C.R.V.) is at least 3 percent when a slider is slid on this resistor.

As to the components of the aforementioned conventional resistive paste materials, the $Bi_2O_3$-$RuO_2$ paste contains Bi and Ru in the mole ratio 4:5 to 4:8 while the $Pb_3O_4$-$RuO_2$ paste contains $Pb_3O_4$ and $RuO_2$ in the mole ratio 1:1 to 2:1. The conventional resistive paste materials thus contain large amounts of high-priced $RuO_2$ are inevitably high in cost.

SUMMARY OF THE INVENTION

The present invention has been proposed to solve the aforementioned problems, and an object thereof is to provide resistive paste, which can be prepared at a low cost to obtain a resistor with small sliding noise.

The resistive paste according to the present invention contains conductive powder, glass frit and organic varnish. The conductive powder is composed of iron oxide, ruthenium oxide, lead oxide and zinc oxide. This conductive powder contains 10 to 25 atomic percent of iron oxide in terms of Fe atoms, 25 to 34 atomic percent of ruthenium oxide in terms of Ru atoms, 25 to 34 atomic percent of lead oxide in terms of Pb atoms, and 10 to 25 atomic percent of zinc oxide in terms of Zn atoms.

Within the components of the resistive paste according to the present invention, the conductive powder is prepared in the above atomic percentages for the following reasons:

If the content of iron oxide is less than 10 atomic percent, it is impossible to reduce the cost since the amount of $RuO_2$ is complementally increased, although no problem is caused in electric properties. If the content of ron oxide exceeds 25 atomic percent, on the other hand, the resistance value is excessively increased and the temperature coefficient of resistance exceeds ±500 ppm/°C. beyond a practical range. Thus, the content of iron oxide is set in the range of 10 to 25 atomic percent in terms of Fe atoms.

If the content of ruthenium oxide is less than 25 atomic percent, the resistance value is excessively increased and the temperature coefficient of resistance exceeds ±500 ppm/°C. If the content of ruthenium oxide exceeds 34 atomic percent, on the other hand, it is impossible to reduce the cost since the amount of $RuO_2$ is increased although no problem is caused in electric properties. Thus, the content of ruthenium oxide is set in the range of 25 to 34 atomic percent in terms of Ru atoms.

If the content of lead oxide is less than 25 atomic percent, it is impossible to reduce the cost since the amount of $RuO_2$ is relatively increased although no problem is caused in electric properties. If the content of lead oxide exceeds 34 atomic percent, on the other hand, the resistance value is excessively increased and the temperature coefficient of resistance exceeds ±500 ppm/°C. beyond a practical range. Thus, the content of lead oxide is set in the range of 25 to 34 atomic percent in terms of Pb atoms.

If the content of zinc oxide is less than 10 atomic percent, it is impossible to reduce sliding noise. If the content of zinc oxide exceeds 25 atomic percent, on the other hand, the resistance value is excessively increased and the temperature coefficient of resistance exceeds ±500 ppm/°C. beyond a practical range. Thus, the content of zinc oxide is set in the range of 10 to 25 atomic percent in terms of Zn atoms.

The glass frit is typically prepared from a lead borosilicate material, for example. The mixing ratio of the glass frit and the above conductive powder is preferably selected in a range of 20 to 70 percent by weight of the conductive powder and 80 to 30 percent by weight of the glass frit. If the content of the conductive powder is less than 20 percent by weight and that of the glass frit exceeds 80 percent by weight, the amount of the glass frit is so excessive that a molten glass component may flow out during firing toward an electrode, for example, to reduce solderability against the electrode. If the content of the conductive powder exceeds 70 percent by weight and that of the glass frit is less than 30 percent by weight, on the other hand, sufficient film strength cannot be attained and the resistor may be deteriorated in electric properties when the same is left under a high temperature or a humid atmosphere.

In order to paste the aforementioned solid components of the conductive powder and the glass frit, it is preferable to add 25 to 35 percent by weight of organic varnish to the solid components. If the content of the organic varnish is less than 25 percent by weight, the contents of the solid components are so increased that it is impossible to attain good printability. If the content of the organic varnish exceeds 35 percent by weight, on the other hand, bleeding is caused in a printed pattern to disable pattern formation in a constant area, leading to dispersion in resistance. The organic varnish is prepared by adding a-terpineol, a solvent, to ethyl cellulose, for example.

In order to prepare the resistive paste, raw materials for the conductive powder, i.e., $Fe_3O_4$, $RuO_2$, $Pb_3O_4$ and ZnO are weighed in prescribed percentages, introduced into a pot with water, and mixed with each other for a prescribed time. Thereafter the water is vaporized, and the mixture is subjected to heat treatment at a temperature of 600° C. to 900° C., to obtain the conductive powder. The conductive powder is mixed with the glass frit and organic varnish in prescribed ratios, to obtain the resistive paste.

This resistive paste is applied by screen printing onto an insulating substrate of alumina, for example, and fired in the air at a temperature of 700° C. to 900° C., for example, to provide a resistor.

These and other objects, features, aspects and advantages of the present invention will become more apparent from the following detailed description of the present invention.

DESCRIPTION OF THE PREFERRED EMBODIMENTS

The present invention is now described in detail with reference to Example.

Conductive components of $Fe_3O_4$, $RuO_2$, $Pb_3O_4$ and ZnO were mixed in atomic percentages in terms of respective metal atoms shown in Table 1, and wet-blended with water in a pot for 24 hours. Then the water was vaporized to obtain dry powder.

This dry powder was introduced into an alumina crucible and held at a temperature of 850° C. for two hours, to obtain conductive powder.

Lead borosilicate glass frit, containing 65 percent by weight of PbO, 31 percent by weight of $SiO_2$, 2 percent by weight of $B_2O_3$, 1 percent by weight of $Al_2O_3$ and 1 percent by weight of $TiO_2$, was added to the conductive powder in percentages shown in Table 1. Then 28 percent by weight of organic varnish was added to and kneaded with the mixtures, to prepare resistive paste materials.

The prepared resistive paste materials were printed onto alumina substrates and fired at a temperature of 850° C. for 10 minutes, to obtain resistors for trimmer potentiometers.

Table 1 also shows sheet resistivity values, cold-side temperature coefficients of resistance (Cold T.C.R.) in a temperature range of −55° C. to +25° C., hot-side temperature coefficients of resistance (Hot T.C.R.) in a temperature range of +25° C. to +150° C., and values of contact resistance variation (C.R.V.) of the samples.

Referring to Table 1, samples shown with marks * are out of the scope of the present invention.

TABLE 1

| Sample No. | Conductive Powder (metal at. %) Fe | Ru | Pb | Zn | Conductive Powder (wt. %) | Glass Frit (wt. %) | Sheet Resitivity (Ω/□) | Cold T.C.R. (ppm/°C.) | Hot T.C.R. (ppm/°C.) | C.R.V. (%) |
|---|---|---|---|---|---|---|---|---|---|---|
| 1 | 16 | 34 | 34 | 16 | 70 | 30 | 8.7K | 182.4 | 264.8 | 0.53 |
| 2 | 16 | 34 | 34 | 16 | 50 | 50 | 34.3K | 32.1 | 136.6 | 0.67 |
| 3 | 16 | 34 | 34 | 16 | 30 | 70 | 247.0K | −139.0 | 11.4 | 0.98 |
| 4 | 10 | 34 | 34 | 22 | 50 | 50 | 10.1K | 124.7 | 229.1 | 0.53 |
| 5 | 10 | 34 | 34 | 22 | 20 | 80 | 1.46K | −339.2 | −137.8 | 1.43 |
| 6* | 10 | 34 | 34 | 22 | 10 | 90 | 11.3K | −438.6 | −216.3 | 3.50 |
| 7 | 22 | 34 | 34 | 10 | 50 | 50 | 11.6K | 36.7 | 167.9 | 0.34 |
| 8 | 22 | 34 | 34 | 10 | 20 | 80 | 1.29K | −384.9 | −173.5 | 0.91 |
| 9 | 20 | 30 | 30 | 20 | 50 | 50 | 25.9K | 47.3 | 177.1 | 0.56 |
| 10 | 20 | 30 | 30 | 20 | 20 | 80 | 1.07K | −453.3 | −212.4 | 1.84 |
| 11 | 25 | 25 | 25 | 25 | 50 | 50 | 165.0K | −65.3 | 83.1 | 0.30 |
| 12 | 25 | 25 | 25 | 25 | 20 | 80 | 2.74K | −483.1 | −262.2 | 1.90 |
| 13* | 30 | 20 | 20 | 30 | 50 | 50 | at least 1G | — | — | — |
| 14* | 54 | 20 | 20 | 6 | 50 | 50 | at least 1G | — | — | — |

As clearly understood from Table 1, the samples of the inventive resistive paste exhibited sheet resistance values within a range of up to 1 MΩ/□ and temperature coefficients of resistance less than ±500 ppm/°C. It is also understood that the inventive samples were excellent in contact resistance variation.

The samples Nos. 13 and 14, which were out of the scope of the present invention, exhibited large sheet resistivity vales, while temperature coefficients of resistance and C.R.V. thereof were unmeasurable.

According to the present invention, it is possible to obtain a resistor exhibiting a sheet resistivity value within a range of up to 1 MΩ/□ and a temperature coefficient of resistance less than ±500 ppm/°C. equivalently to the general resistor of $Fe_3O_4$-$RuO_2$-$Pb_3O_4$, containing no zinc oxide, with conductive powder which is composed of iron oxide, ruthenium oxide, lead oxide and zinc oxide.

Further, it is also possible to greatly improve the sliding noise property, which has been problematic in the conventional resistor, to usefully apply the resistor to a semi-fixed resistor.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. Resistive paste containing conductive powder, glass frit and organic varnish, said conductive powder being composed of iron oxide, ruthenium oxide, lead oxide and zinc oxide, and containing 10 to 25 atomic percent of iron oxide in terms of Fe atoms, 25 to 34 atomic percent of ruthenium oxide in terms of Ru atoms, 25 to 34 atomic percent of lead oxide in terms of Pb atoms, and 10 to 25 atomic percent of zinc oxide in terms of Zn atoms.

2. Resistive paste in accordance with claim 1, wherein said conductive powder and said glass frit are contained in an amount of 20 to 70 percent by weight and of 80 to 30 percent by weight respectively.

3. Resistive paste in accordance with claim 2, wherein said organic varnish is contained in an amount of 25 to 35 percent by weight with respect to the total content of said conductive powder and said glass frit.

4. Resistive paste in accordance with claim 3, in which said glass is borosilicate glass.

5. Resistive paste in accordance with claim 4, in which the amount of iron oxide is 10 to 16%.

6. Resistive paste in accordance with claim 4, in which the amount of iron oxide is 20 to 25%.

7. Resistive paste in accordance with claim 1, in which said glass is borosilicate glass.

8. Resistive paste in accordance with claim 1, wherein said organic varnish is contained in an amount of 25 to 35 percent by weight with respect to the total content of said conductive powder and said glass frit.

* * * * *